US012589280B2

(12) United States Patent
Da Costa Carvalhais et al.

(10) Patent No.: US 12,589,280 B2
(45) Date of Patent: Mar. 31, 2026

(54) DEVICE AND SYSTEM FOR EXERCISING AND MONITORING THE PELVIC FLOOR MUSCLES

(71) Applicant: UNIVERSIDADE DO PORTO, Oporto (PT)

(72) Inventors: Alice Maria Da Costa Carvalhais, Oporto (PT); Manuel Renato Natal Jorge, Oporto (PT); Joaquim Gabriel Magalhães Mendes, Oporto (PT); Joana Patrícia Da Costa Cerqueira, Oporto (PT)

(73) Assignee: UNIVERSIDADE DO PORTO, Oporto (PT)

( * ) Notice: Subject to any disclaimer, the term of this patent is extended or adjusted under 35 U.S.C. 154(b) by 129 days.

(21) Appl. No.: 18/738,016

(22) Filed: Jun. 9, 2024

(65) Prior Publication Data

US 2024/0325823 A1 Oct. 3, 2024

Related U.S. Application Data

(63) Continuation-in-part of application No. 17/413,589, filed as application No. PCT/IB2019/060715 on Dec. 12, 2019, now Pat. No. 12,017,113.

(51) Int. Cl.
*A63B 24/00* (2006.01)
*A63B 23/20* (2006.01)

(52) U.S. Cl.
CPC ..... *A63B 24/0087* (2013.01); *A63B 23/20* (2013.01); *A63B 2220/24* (2013.01); *A63B 2225/50* (2013.01)

(58) Field of Classification Search
CPC . A63B 24/0087; A63B 23/20; A63B 2220/24; A63B 2225/50; A63B 2220/40;
(Continued)

(56) References Cited

U.S. PATENT DOCUMENTS 6,063,045 A * 5/2000 Wax ..... A61M 25/10 482/8
7,686,747 B1 * 3/2010 Blackford ..... A63B 23/20 482/105

(Continued)

*Primary Examiner* — Garrett K Atkinson
(74) *Attorney, Agent, or Firm* — Rivka Friedman

(57) ABSTRACT

The present invention relates to a device for exercising the pelvic floor muscles in women, which comprises a main component (A'), and a secondary element (D'), wherein the main component (A') comprises a substantially cylindrical body (C'), an internal probe apparatus and a lid (12'). Component (A') is directly related to pelvic floor muscle contraction exercise. Component (D') restricts the movement of the main component (A'), preventing the rotation of said main component (A') while being used by the user, which improves the performance of the exercise, and allows the user to adjust the length of the proximal portion (1') of the body (C') to be inserted, according to the user's anatomy and comfort needs. The internal probe apparatus is configured to establish wireless communications with an external computation device running a software program so that the user can monitor the contraction movement of the pelvic floor muscles during exercise. Thus, this invention falls within the technical field of mechanical functioning devices, with application to the medical area, for the treatment and/or prevention of pathological situations related to the alteration of the muscular function of the pelvic floor region.

19 Claims, 4 Drawing Sheets

Figure 1:
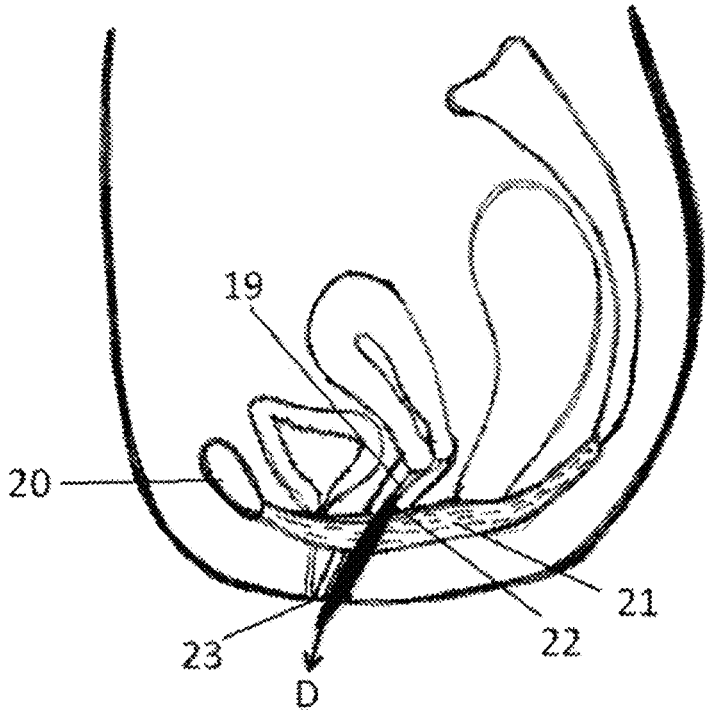

(58) Field of Classification Search
CPC ..... A63B 2220/803; A63B 2220/833; A63B 2225/74
See application file for complete search history.

(56) References Cited

U.S. PATENT DOCUMENTS

| | | | | |
|---|---|---|---|---|
| 8,550,088 | B1 * | 10/2013 | Booher, Sr. ..... | A61B 17/4241 128/846 |
| 10,150,001 | B1 * | 12/2018 | Blackford ..... | A63B 21/0624 |
| 2012/0053017 | A1 * | 3/2012 | Kushnir ..... | A63B 23/20 482/121 |
| 2013/0130871 | A1 * | 5/2013 | McCoy ..... | A63B 23/20 482/113 |
| 2021/0393474 | A1 * | 12/2021 | Hernan ..... | A61H 21/00 |

* cited by examiner

DEVICE AND SYSTEM FOR EXERCISING AND MONITORING THE PELVIC FLOOR MUSCLES

The present application claims the benefit of, and is a continuation of, U.S. non-provisional patent application Ser. No. 17/413,589, filed Jun. 14, 2021, entitled DEVICE FOR EXERCISING THE PELVIC FLOOR MUSCLES.

TECHNICAL FIELD OF THE INVENTION

The present invention relates to a device to exercise the pelvic floor muscles in women, through the vaginal canal.

The device comprises a main component (A'), a secondary element (D'), and optionally a set of external weights (P'). The main component (A') is related to the action resulting from the contraction of the pelvic floor muscles, namely the levator ani, and through which the exercises for exercising the pelvic floor muscles are performed, with or without the addition of resistant force; the secondary element (D') allows the user to adjust the device according to the user's anatomy and comfort needs for the execution of the pelvic floor muscles contraction exercise; the set of individual weights (P/P'), with different loads, allows imposing resistance of different magnitudes to the contraction of the pelvic floor muscles.

The resistance applied, through this device, increases the cephalic and anterior displacement of the urethra, vagina and rectum, which promotes the closure of these structures.

In this way, the present invention falls within the technical field of mechanical functioning devices, with application to the medical area, for the treatment and prevention of pathological situations related to the loss of tone and muscle dysfunction in the pelvic floor region.

BACKGROUND OF THE INVENTION

The pelvic floor muscles have two important functions: supporting pelvic structures such as the bladder, bladder neck and urethra, and in the mechanism of the urethral sphincter. Factors associated with age, menopause, vaginal delivery, episiotomy, chronic constipation, chronic coughing and high-impact exercise have an influence on pelvic floor muscles and can alter their normal function and lead to a range of problems or dysfunctions such as urinary incontinence, pelvic organ prolapse, anal incontinence, sensory disorders of the lower urinary tract, defecatory dysfunction, sexual dysfunction and pelvic organ-related pain syndromes.

In recent years, clinical treatment, in particular pelvic floor muscle exercising, has proved effective in developing pelvic floor muscle strength.

Several devices are known for this purpose, including for instance, EDUCATOR®—Pelvic Floor Exercise Indicator, from NEEN-Performance Health, UK. This device consists of an element to be inserted into the vagina, coupled to an external indicator rod. (http://www.neenpelvichealth.com/uploads/products/neen-professional-catalogue_educator.pdf).

This device is shaped forward so that it rests on the vagina and remains there during use. When contracting the pelvic floor, the deep layer of the pelvic floor muscles should shorten and lift. This movement lifts the intravaginal element by moving the indicator rod downward toward the coccyx, indicating a correct contraction. One of the main disadvantages of EDUCATOR® is that the movement of the indicator rod always develops in favour of gravity. In addition, its plastic components, such as the flexible external indicator rod, do not make it possible to add any external weight that would impose resistance of different magnitudes on the contraction of the pelvic floor muscles. Additionally, it is not possible to quantify the displacement of said external indicator rod.

KEGELMASTER™, from Kegelmaster, USA is another device of this kind. It comprises an intravaginal handle-shaped component and a set of springs. The device, when inserted, provides resistance to contraction of the pelvic floor muscles. However, the resistance is triggered by the placement of the springs inside the intravaginal component forcing, during the exercising session, the removal of the device to change them. (https://www.kegelmaster.com/what-is-the-kegelmaster.html)

US2010/0051036 A1 discloses another device, the "Intravaginal device", which allows the application of a resistant force of different magnitudes, in order to perform the strength exercising of the pelvic floor muscles also in the standing position. However, and as illustrated in FIG. 1, the resistant force, obtained through the spring system, is performed not in the direction of the fibres of the main muscles, but in a perpendicular direction thereto.

Also known is the technique of vaginal cones, but for use in the orthostatic position, promoting the application of a resistant force, of different magnitudes, similar to the aforementioned device and, therefore, with the same disadvantages as previously mentioned.

This invention aims to overcome the aforementioned disadvantages of said techniques, proposing for that purpose, a device to exercise the pelvic floor muscles, which allows the addition of external weights, the monitoring and quantification of the resistance imposed on the muscles to exercise, rendering its removal during the exercise session unnecessary. In addition, it has the additional advantage of enhancing the cephalic and anterior displacement of the urethra, vagina and rectum, promoting the closure of these structures.

SUMMARY OF THE INVENTION

This invention relates to a device to exercise the pelvic floor muscles, in women, through the vaginal canal, useful for the treatment or prevention of pathologies related to the alteration of the muscular function of this anatomical region.

The object of the present invention is a device for exercising the pelvic floor muscles comprising a main component (A'), a secondary element (D'), and a set of weights (P'), wherein the main component (A') comprises a body (C'), an internal probe apparatus and a lid (12').

The body (C') comprises a substantially cylindrical and hollow shape, consisting of a proximal portion (1') comprising a rounded tip and a distal portion (2') comprising an external surface having a longitudinal groove and a plurality of slits longitudinally positioned along the external surface of the body (C'), and further comprising an opening of the internal cavity of the body (C').

The internal probe apparatus is located inside the internal cavity of the body (C') and comprises a microcontroller (7'), an inertial measurement unit, a step-up converter (8') and a power supply, wherein the power supply provides electrical power to the step-up converter (8'), the step-up converter (8') is configured to adjust the electrical power and to distribute said electrical power to the microcontroller (7') and to the inertial measurement unit, the inertial measurement unit is configured to measure orientation data of resistance forces applied to the body (C'), and the microcontroller (7') is configured to process the orientation data measured by the inertial measurement unit. The lid (12') is configured to cover the opening of the internal cavity of the body (C'). Preferably, the inertial measurement unit is integrated in the microcontroller (7') and is configured to provide 6 axis orientation data of the movement of the body (C') of the main component (A').

The secondary element (D') comprises an inner adapter (61') having a hole (O) adapted to receive the body (C') of the main component (A'), being configured to engage with the longitudinal groove and with the slits of the distal portion (2') of the body (C') of the main component (A') to secure said inner adapter (61') around the external surface of the body (C') at a fixed distance to the rounded tip of the proximal portion (1') of the body (C') of the main component (A'), and an external adapter (62') adapted to be fitted to the clothes of the user, being the external adapter (62') connected to the inner adapter (61') by flexible connection means (63').

The secondary element (D') allows the user to adjust the length of the proximal portion (1') of the bocy (C') to be inserted, according to the user's anatomy and comfort needs. The body (C') is thereby threaded through the hole (O) of the inner adapter (61') and can slide along the longitudinal groove of the body (C'), wherein the plurality of slits can lock the inner adapter (61') in a predefined position at a given distance to the round tip of the body (C'). Preferably, the slits comprise a semispherical shape and are positioned along the external surface of the body (C') in the opposite side to the longitudinal groove. The combined action of the longitudinal groove and of the slits facilitate the adjustments to be performed by the user.

In an advantageous aspect of the present invention, the securing action of the secondary element (D') restricts the movement of the main component (A'), preventing the rotation of said main component (A') while being used by the user, which improves the performance of the exercise.

In an advantageous aspect of the present invention, the set of weights (P') provide an additional load of resistant force, applied to the body (C'), thus allowing to impose a variable resistance, of different magnitudes, to the contraction of the pelvic floor muscles, and appropriate to each case and objective, without the need to remove the device during the session. The resistance force applied to the body (C'), while the device is being used by a user, is performed in the perpendicular direction on the levator ani muscle and opposite to its contraction. The main component (A') is related to the anti-gravity movement and the action resulting from the contraction of the pelvic floor muscles. The resistant force, exerted by the device, is applied directly on the levator ani, relating the movement of the main component (A') only to its contraction. The resistance applied through this device simulates the one imposed by the manual reinforcement (bidigital), thus enhancing the cephalic and anterior displacement of the urethra, vagina and rectum, promoting the closure of these structures.

BRIEF DESCRIPTIONS OF THE DRAWINGS

FIG. 1 shows a device of the state of the art (comparative), in which the arrow represents the action of the resistant force, obtained through a spring system, occurring in the direction perpendicular to the levator ani muscle, as is the case with the "Intravaginal device" (D/D'), in which:

19—Vaginal canal,
20—Pubic symphysis,
21—Levator ani muscle,
22—Intravaginal portion of the main component,
23—Extravaginal portion of the main component.

Figure 2:
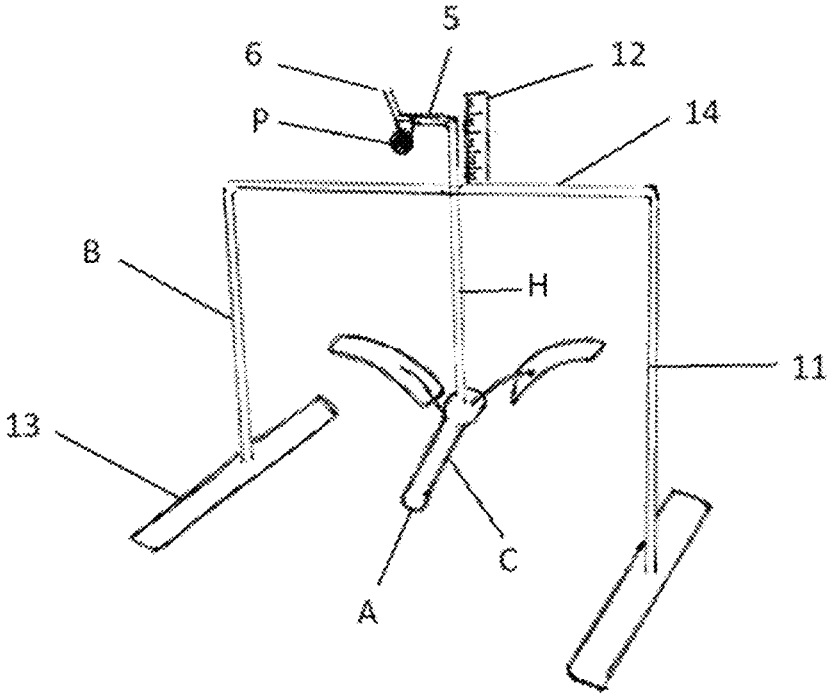

FIG. 2 represents an antero-lateral view of the device of this invention (inventive), namely the set comprising the main component (A) and the secondary component (B), reflecting the relationship established between them when used, namely a quantification of the strength of muscle resistance that is visible to the user, in which:

A—Main component,
C—Substantially cylindrical body,
H—Rod,
5—Intermediate region of rod H,
6—Upper region of rod H,
B—Secondary component,
11—Vertical beams,
12—Graduated ruler,
13—Support bases,
14—Horizontal beam,
P—example of weight.

Figure 3:
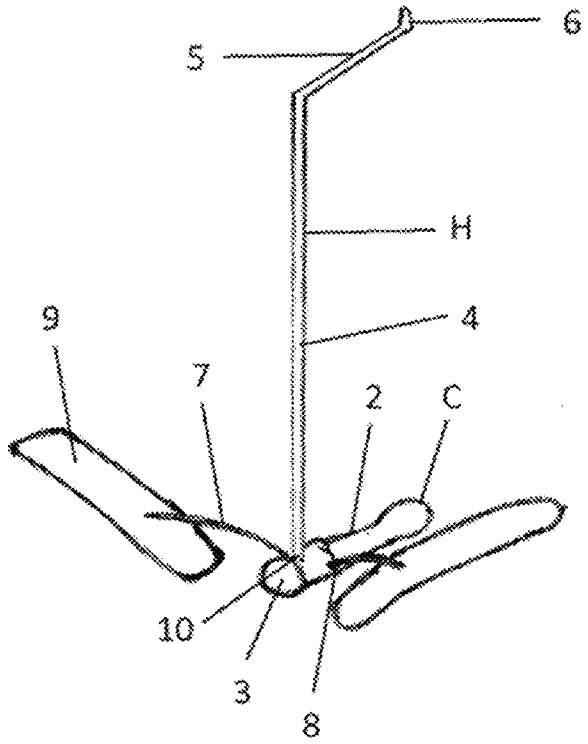

FIG. 3 refers to a postero-lateral view of component (A) of the device of the present invention, illustrating some of its different constituents, in which:

C—Cylindrical body of the main component (A),
H—Main component rod (A),
2—Intermediate portion of the body (C),
3—Extravaginal portion of the body (C),
4—Lower rod region (H),
5—Intermediate rod region (H),
6—Upper rod region (H),
7—Rigid crosspieces, connecting to supports (9),
8—Side hole, in body C, for insertion of crosspiece (7),
9—Body support (C),
10—Upper hole, in body C, for rod insertion (H).

Figure 4:
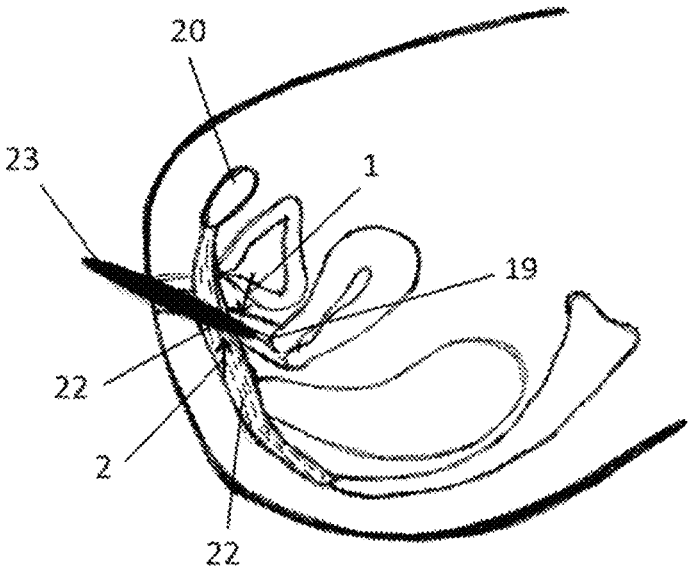

FIG. 4 shows the resistant force (arrow 1), resulting from the action of the device of the present invention, when the force is applied directly on the levator ani muscle, occurring in the direction of contraction of this muscle (arrow 2), in which:

19—Vaginal canal,
20—Pubic symphysis,
21—Levator ani muscle,
22—Intravaginal portion of the main component (A/A'),
23—Extravaginal portion of the main component (A/A').

Figure 5:
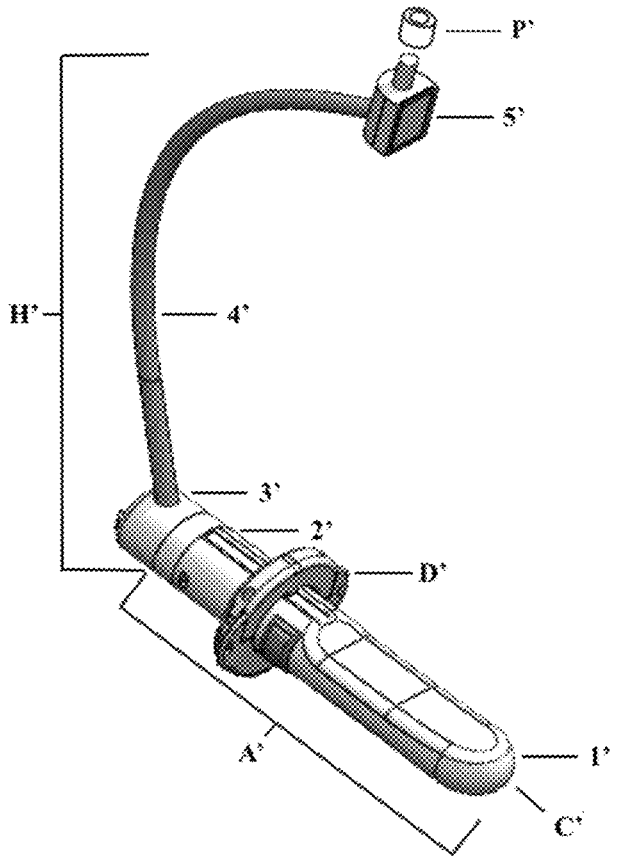

FIG. 5 illustrates the preferred embodiment of the device:

A'—Main component of the device,
C'—Body of the main component of the device,
H'—External stem,
1'—Proximal portion of the body of the main component
2'—Distal portion of the body of the main component,
3'—Lower portion of the external stem,
4'—Upper portion of the external stem,
5'—Handler,
D'—Secondary element of the device.

Figure 6:
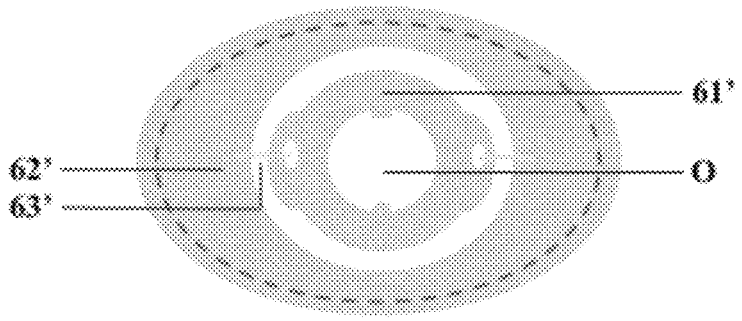

FIG. 6 illustrates the secondary element (D') of the device, comprising:

O—Hole of the inner adapter,
61'—Inner adapter,
62'—External adapter,
63'—Flexible connection means.

Figure 7:
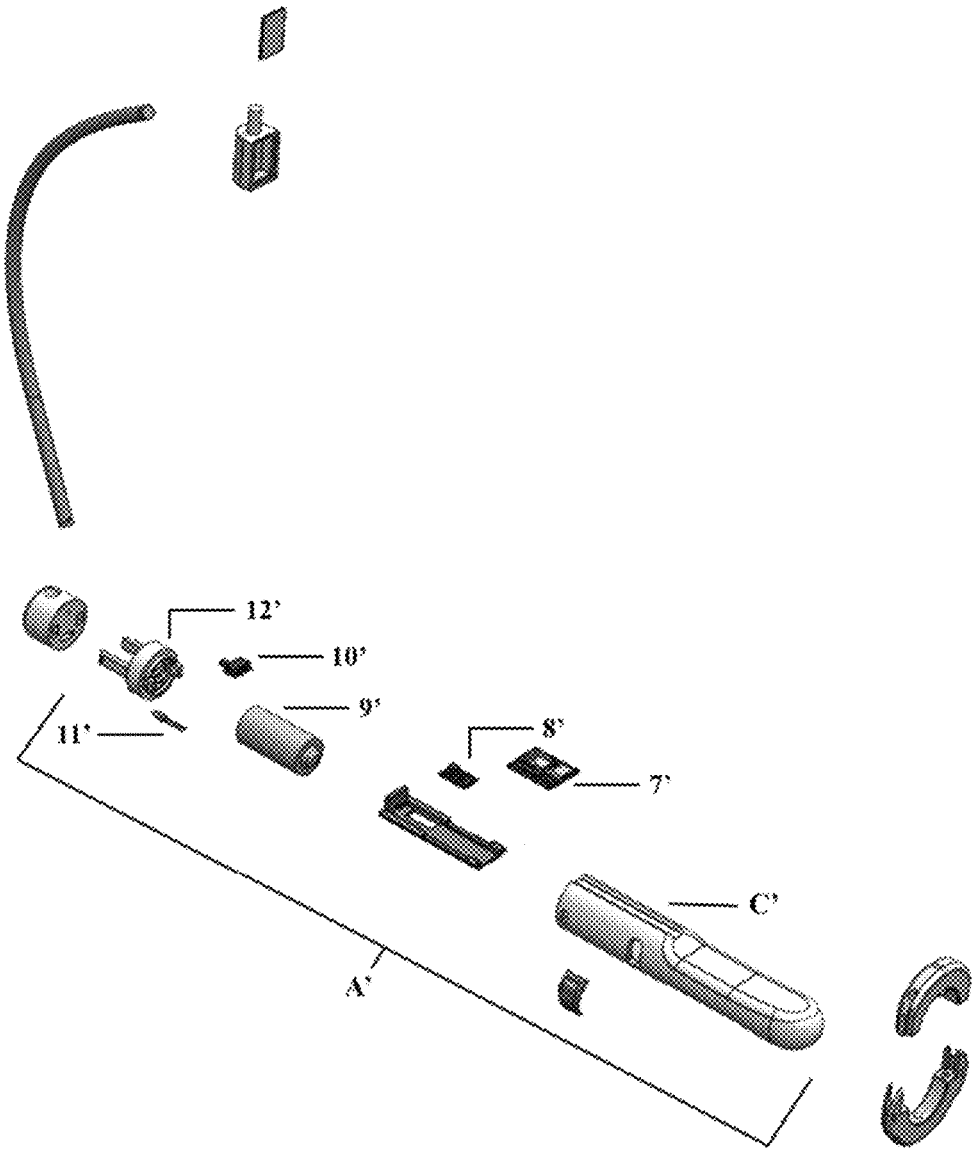

FIG. 7 represents an exploded view of the device and all the components of the device.

7'—Microcontroller,
8'—Step-up converter,
9'—Rechargeable battery,
10'—Power switch,
11'—Light indicator means: LED,

12'—Lid.

DESCRIPTION OF THE INVENTION

Embodiment 1

This invention relates to a device to exercise the pelvic floor muscles, in women, through the vaginal canal, useful for the treatment or prevention of pathologies related to the alteration of the muscular function of this anatomical region.

The device comprises a main component (A), a secondary component (B) and optionally a set of external weights (P).

The main component (A) is related to the anti-gravity movement and the action resulting from the contraction of the pelvic floor muscles. The resistant force, exerted by the device, is applied directly on the levator ani, relating the movement of the rod (A) only to its contraction. The resistance applied through this device simulates the one imposed by the manual reinforcement (bidigital), thus enhancing the cephalic and anterior displacement of the urethra, vagina and rectum, promoting the closure of these structures.

It is possible to apply a load of resistant force, through the addition of weights (P), applied to the component (A), in its extravaginal portion, thus allowing to impose a variable resistance, of different magnitudes, to the contraction of the pelvic floor muscles, and appropriate to each case and objective, without the need to remove the device during the session.

The secondary component (B) allows the monitoring of the exercises and the contraction of the pelvic floor muscles, in particular if it is performed correctly and sufficiently for the intended purpose, by measuring the displacement of a rod (H), which is quantified on a graduated ruler.

The main component (A), as shown in FIG. 3, comprises a substantially cylindrical body (C), a vertical rod (H), two crosspieces (7) and two supports (9).

The body (C) has a substantially cylindrical shape, of the type of menstrual tampons, being composed of an intravaginal portion, with a rounded tip (1) and an intermediate portion (2) and, an extravaginal portion (3).

The portions (1 and 2) of the body (C) are specially adapted to be in contact with the levator ani muscle (21), thus exerting a resistant force in the perpendicular direction on the said muscle and opposed to its contraction (arrow 1), as shown in FIG. 4.

The extravaginal portion (3) of the body (C) comprises, on its upper side, a hole (10) suitable for the insertion of the rod (H), and on each of its sides, a hole (8), which are suitable for the insertion of the crosspieces (7).

The rod (H) has a lower region (4), an intermediate region (5) and an upper region (6), inserting itself, through its lower region (4), in the hole (10) to connect mechanically with the cylindrical body (C), forming an internal angle preferably of about 100°. The lower region (4) forms an internal angle preferably of 100° with the intermediate region (5). The intermediate region (5) and the upper region (6) form an internal angle, preferably of 45°, to fit the external weights (P), which increase the resistance to contraction of the muscles of the pelvic floor of the user, generating a displacement of the rod (H) in the mid-sagittal plane of the user's body.

The pair of supports (9), have an essentially rectangular shape and slightly curved, with a concave side, so as to be supported in the antero-medial region of the user's thigh. Each of these supports (9) is attached to a rigid beam (7), through the lateral holes (8), of the body (C), in order to make the connection with the extravaginal portion (3) of said body (C). This connection is achieved by means of a 3D articulation, thus enabling the rotation in any of the three orthogonal axes.

The secondary component (B), as shown in FIG. 2, comprises two vertical beams (11), a graduated ruler (12), two support bases (13) and a horizontal beam (14).

The vertical beams (11) are rigid and adjustable in length, each comprising an upper end and a lower end.

The horizontal beam (14) is rigid, with a circular, length-adjustable section, arranged at the upper ends of each vertical beam (11) to connect them.

The support base (13), rigid and substantially rectangular in shape, is mounted on each of the lower ends of the vertical beams (11).

The ruler (12) can be graduated in mm or inches and is arranged vertically and perpendicular to the horizontal beam (14) at its midpoint. The graduated ruler (12) allows the evaluation and quantification of the displacement of the upper region (6) of the rod (H), allowing the monitoring of the different types of muscle contraction performed against resistance (concentric, eccentric, isometric).

The weights (P) are placed, when necessary, in the intermediate region (5) of the rod (H), in an external location to the user's body, through a ring in the upper part of the weight.

Consequently, there is no need to remove the body (C) from the device of the invention, after its insertion into the vaginal canal, to modify the load applied to the device.

The weights (P) present different loads, to be used according to the needs and objectives to be reached, each one of them can vary between 5 and 40 g, with a 5 g gradient, being possible to associate more than 1 weight each time, as for example x, x+1, x+2 and y.

In FIG. 4, arrow 1 represents the resistant force, applied in the direction of the muscle fibers, which is obtained by the action of the device of the present invention. The movement of the body (C) is rotational, instead of the linear movement exerted by the device of the state of the art, represented in FIG. 1. Thus, the force applied through the device of invention is closer to that imposed by manual reinforcement (bidigital), enhancing, in a substantially advantageous way, the cephalic and postero-anterior displacement of the muscles mentioned above.

The device of the present invention can be made totally or partially of rigid material, such as plastic, metal, among others, preferably recyclable and light materials, so as not to induce discomfort.

The cylindrical body (C) is preferably made of rigid material, such as plastic, metal, among others, preferably recyclable and light materials, so as not to induce discomfort. It may or not be coated with sterilisable material by physical and/or chemical means, such as radiation, pressure and steam, or by contact with chemical sterilisation agents.

The application of the device may be performed by adding a disposable coating of material compatible with the vaginal mucosa, such as a condom, which allows the device to be used by one or more users.

The device comprises a coating that is easy to sanitize and sterilization substances can be applied. Its easy handling allows it to be used both in the hospital and at home.

The extravaginal portion (3) of the body (C) and each of the rigid rods (7) has a preferential angle of 45° in respect to the longitudinal axis of the cylindrical body (C).

The configuration of the secondary component (B), in the shape of an inverted U, ensures that the cylindrical body (C)

does not move longitudinally, in the vaginal canal, during the execution of the exercises.

A number of embodiments of the device may also include the addition of at least one sensor, selected from the group of pressure sensors, motion sensors, rotation sensors, slope sensors, acceleration sensors, among others.

The device can also be monitored via an electronic application connected to a suitable software for this purpose.

Following the recommendations of the American College of Sports Medicine, the device can be associated with a pelvic floor muscle strength exercising program in order to develop hypertrophy, endurance or power.

The device of this invention is particularly suitable for exercising the pelvic floor muscles in users positioned in the dorsal decubitus position.

The main component (A), in particular the body (C), is related to the action resulting from the contraction of the pelvic floor muscles, which, being in direct contact with the levator ani muscle, exerts a resistant force in the perpendicular direction on that muscle and opposed to its contraction.

Its application is especially advantageous for strengthening the pelvic floor muscles, especially the levator ani, adjusting the type of contraction (isometric, concentric, eccentric) and the strength resistant to the type of exercise involved (hypertrophy, endurance, power), appropriate to the specific dysfunctions of each patient.

The main distinguishing features are as follows:

- Possibility of evaluation and qualitative and quantitative monitoring of each exercising session to strengthen the pelvic floor muscles;
- Special action directed to the levator ani muscle, by the contraction type exercised (isometric, concentric, eccentric) in reaction to the resistant force;
- Adjustment of load and type of force exerted to the intended target (hypertrophy, endurance, power), appropriate to the specific dysfunctions of each patient;
- Implementation of different loads during the same exercising session, without the need to remove the body of the device from the user's intravaginal region;
- Maintenance of the correct positioning of the body of the device, thanks to the ergonomics provided by the concave supports resting on the user's thighs.

Embodiment 2

This invention relates to a device to exercise the pelvic floor muscles, in women, through the vaginal canal, useful for the treatment or prevention of pathologies related to the alteration of the muscular function of this anatomical region.

The object of the present invention is a device for exercising the pelvic floor muscles comprising a main component (A'), and a secondary element (D'), wherein the main component (A') comprises a substantially cylindrical body (C'), an internal probe apparatus and a lid (12').

The body (C') comprises a substantially cylindrical and hollow shape, consisting of a proximal portion (1') comprising a rounded tip and a distal portion (2') comprising an external surface having a longitudinal groove and a plurality of slits longitudinally positioned along the external surface of the body (C'), and further comprising an opening of the internal cavity of the body (C').

The internal probe apparatus is located inside the internal cavity of the body (C') and comprises a microcontroller (7'), an inertial measurement unit, a step-up converter (8') and a power supply, wherein the power supply provides electrical power to the step-up converter (8'), the step-up converter (8') is configured to adjust the electrical power and to distribute said electrical power to the microcontroller (7') and to the inertial measurement unit, the inertial measurement unit is configured to measure orientation data of resistance forces applied to the body (C'), and the microcontroller (7') is configured to process the orientation data measured by the inertial measurement unit. The lid (12') is configured to cover the opening of the internal cavity of the body (C'). Preferably, the inertial measurement unit is integrated in the microcontroller (7') and is configured to provide 6 axis orientation data of the movement of the body (C') of the main component (A').

The secondary element (D') comprises an inner adapter (61') having a hole (O) adapted to receive the body (C') of the main component (A'), being configured to engage with the longitudinal groove and with the slits of the distal portion (2') of the body (C') of the main component (A') to secure said inner adapter (61') around the external surface of the body (C') at a fixed distance to the rounded tip of the proximal portion (1') of the body (C') of the main component (A'), and an external adapter (62') adapted to be fitted to the clothes of the user, being the external adapter (62') connected to the inner adapter (61') by flexible connection means (63').

The secondary element (D') allows the user to adjust the length of the proximal portion (1') of the bocy (C') to be inserted, according to the user's anatomy and comfort needs. The body (C') is thereby threaded through the hole (O) of the inner adapter (61') and can slide along the longitudinal groove of the body (C'), wherein the plurality of slits can lock the inner adapter (61') in a predefined position at a given distance to the round tip of the body (C'). Preferably, the slits comprise a semispherical shape and are positioned along the external surface of the body (C') in the opposite side to the longitudinal groove. The combined action of the longitudinal groove and of the slits facilitate the adjustments to be performed by the user.

In an advantageous aspect of the present invention, the securing action of the secondary element (D') restricts the main component (A') to rotate while being used by the user, which improves the performance of the exercise.

The resistance force applied to the body (C'), while the device is being used by a user, is performed in the perpendicular direction on the levator ani muscle and opposite to its contraction. The main component (A') is related to the anti-gravity movement and the action resulting from the contraction of the pelvic floor muscles. The resistant force, exerted by the device, is applied directly on the levator ani, relating the movement of the main component (A') only to its contraction. The resistance applied through this device simulates the one imposed by the manual reinforcement (bidigital), thus enhancing the cephalic and anterior displacement of the urethra, vagina and rectum, promoting the closure of these structures.

FIG. 5 illustrates the preferred embodiment of the present invention, being a device for exercising the pelvic floor muscles comprising a main component (A'), and a secondary element (D'), wherein the main component (A') comprises a substantially cylindrical body (C'), an internal probe apparatus, a lid (12') and an external stem (H') having a lower portion (3'), and an upper portion (4'), wherein the lower portion (3') is configured to connect to the lid (12') of the main component (A').

If necessary, the device may comprise a handler (5') configured to support a set of weights (P'), with variable loads from 5 to 40 g to be used according to the needs and objectives to be reached, being possible to associate more than 1 weight each time, as for example x, x+1, x+2 and y. The handler (5') is connected to the upper portion (4') of the external stem (H').

Consequently, there is no need to remove the body (C) from the device of the invention, after its insertion into the vaginal canal, to modify the load applied to the device.

In an advantageous aspect of the present invention, the lid (12') comprises at least two brackets configured to connect with the lower portion (3') of the external stem (H'), and further comprises at least two notches configured to provide a tight seal of the opening of the internal cavity of the body (C'). The function of the notches is to protect the components of the internal probe apparatus from oxidation by having a tight seal between the lid (12') and the body (C'). Moreover, the brackets provide means of connection with the external stem (H') so that the set of weights may be added to the handler (5') to increase the resistance.

In another embodiment of the present invention, the lid (12') may comprise a power switch (10'), configured to turn on and/or turn off the internal probe apparatus, and may have light indicator means (11'), such as a LED light, configured to emit a light signal according to the power state of the internal probe apparatus.

In another embodiment of the present invention, the handler (5') may comprise a visual force meter comprising light indicator means (11') such as LEDs configured to provide visual feedback according to the data measured by the inertial measurement unit, thus informing the user about the contraction execution. In addition, the handler (5') may also comprise an auditory alert apparatus configured to produce sounds according to the data measured by the inertial measurement unit, thus reflecting on the performance of the user while using the device by providing auditory feedback to the user regarding the execution of the contraction.

In a preferred embodiment of the present invention, the internal probe apparatus comprises a rechargeable battery (9') as power supply, wherein the lid (12') of the main component (A') may comprise a charging port, such as a micro-USB port, in connection with the internal probe apparatus so to provide power to the battery (9').

A number of embodiments of the device may also include the addition of at least one sensor, selected from the group of pressure sensors, motion sensors, rotation sensors, slope sensors, acceleration sensors, among others.

Embodiment 3

This invention relates to a system for monitoring the contraction movement of the pelvic floor muscles, in women, through the vaginal canal, useful for the treatment or prevention of pathologies related to the alteration of the muscular function of this anatomical region.

In a more preferred embodiment of the present invention, the microcontroller (7') of the main component (A') of the device for exercising the pelvic floor muscles is configured to establish wireless communications, via Wi-Fi or Bluetooth Low Energy, with an external computation device, such as a smartphone, tablet or computer.

In another embodiment of the present invention, the set of weights (P') are located inside the internal cavity of the body (C') of the main component (A'), providing an additional load of resistant force, applied to the body (C'), thus allowing to impose a variable resistance, of different magnitudes, to the contraction of the pelvic floor muscles, and appropriate to each case and objective, while reducing the external volume of the device, wherein variable loads may be placed inside the internal cavity of the body (C') without increasing the overall volume of the distal portion (2') of the device.

Preferably, the way to use the device for exercising the pelvic floor muscles comprises the step of performing at least one pelvic floor muscle exercise with the device.

It is also an object of the present invention a system for monitoring the contraction movement of the pelvic floor muscles comprising the device for exercising the pelvic floor muscles and an external computation device running a software program application to monitor in real-time the performance of each exercise performed. The user is provided by the external computation device with visual feedback information in real time, such as the contraction angles of the pelvic floor muscles. The external computation device is configured to establish a wireless communication with the microcontroller (7') of the main component (A'), so that data measured by the inertial measurement unit during, the performance of at least one exercise of the pelvic floor muscles, is transmitted to the microcontroller (7') and then further transmitted by wireless communications, such as Wi-Fi or Bluetooth Low Energy, to the external computation device. The external computation device may comprise a smartphone, a tablet or a computer capable of running a monitoring software application which would allow the user to have information about the personal performance while using the device, to guide the user and to allow the user to perform adjustments to the exercise routines in order to achieve the desired goals. Therefore, the preferred way to use the system for monitoring the contraction movement of the pelvic floor muscles comprises the steps of performing at least one pelvic floor muscle exercise with the device and the step of monitoring the performance of the movement of the contraction of the pelvic floor muscle with the software program running in the external computation device.

The invention claimed is:

1. A device for exercising the pelvic floor muscles comprising a main component (A'), a secondary element (D'), and a set of weights (P'), wherein:

the main component (A') comprises a body (C'), an internal probe apparatus and a lid (12'), in which:

the body (C') comprises a substantially cylindrical and hollow shape, comprising a proximal portion (1') comprising a rounded tip and a distal portion (2') comprising an external surface having a longitudinal groove and a plurality of slits longitudinally positioned along the external surface of the body (C'), and further comprising an opening of the internal cavity of the body (C');

the internal probe apparatus is located inside the internal cavity of the body (C') and comprises a microcontroller (7'), an inertial measurement unit, a step-up converter (8') and a power supply, wherein the power supply provides electrical power to the step-up converter (8'), the step-up converter (8') is configured to adjust the electrical power and to distribute said electrical power to the microcontroller (7') and to the inertial measurement unit, the inertial measurement unit is configured to measure orientation data of resistance forces applied to the body (C'), and the microcontroller (7') is configured to process the orientation data measured by the inertial measurement unit; and the lid (12') is configured to cover the opening of the internal cavity of the body (C');

the secondary element (D') comprises an inner adapter (61') having a hole (O) adapted to receive the body (C') of the main component (A'), being configured to engage with the longitudinal groove and with the slits of the distal portion (2') of the body (C') of the main component (A') to secure said inner adapter (61') around the external surface of the body (C') at a fixed distance to the rounded tip of the proximal portion (1') of the body (C') of the main component (A'), and an external adapter (62') adapted to be fitted to the clothes of the user, the external adapter (62') connected to the inner adapter (61') by flexible connection means (63'); and the set of weights (P') comprises variable loads from 5 to 40 g;

wherein the resistance force applied to the body (C') is performed in the perpendicular direction on the levator ani muscle and opposite to its contraction.

2. The device according to claim 1 wherein the set of weights (P') are located inside the internal cavity of the body (C') of the main component (A').

3. The device according to claim 1 further comprising an external stem (H') having a lower portion (3'), and an upper portion (4'), wherein the lower portion (3') is configured to connect to the lid (12') of the main component (A').

4. The device according to claim 3, further comprising a handler (5') configured to support the set of weights (P'), being the handler (5') connected to the upper portion (4') of the external stem (H').

5. The device according to claim 4 wherein the handler (5') further comprises a visual force meter comprising light indicator means (11') configured to produce light signals according to the data measured by the inertial measurement unit.

6. The device according to claim 4 wherein the handler (5') further comprises an auditory alert apparatus configured to produce sounds according to the data measured by the inertial measurement unit.

7. The device according to claim 1 wherein the lid (12') comprises at least two brackets configured to connect with the lower portion (3') of the external stem (H').

8. The device according to claim 1 wherein the lid (12') comprises at least two notches configured to provide a tight seal of the opening of the internal cavity of the body (C').

9. The device according to claim 1 wherein the lid (12') comprises a power switch (10') configured to turn on and/or turn off the internal probe apparatus.

10. The device according to claim 9 wherein the lid (12') further comprises light indicator means (11') configured to emit a light signal according to the power state of the internal probe apparatus.

11. The device according to claim 1 wherein the power supply comprises a battery (9').

12. The device according to claim 1 wherein the lid (12') comprises a charging port to provide power to the battery (9').

13. A method of using the device of claim 1 comprising the step of performing at least one pelvic floor muscle exercise with the device.

14. The device as claimed in claim 1, wherein the device is configured for treatment and/or prevention of pathological situations related to the alteration of muscle function in the pelvic floor region.

15. The device according to claim 1, characterized in that the microcontroller (7') is configured to establish wireless communications with an external computation device.

16. The device according to claim 15, characterized in that the wireless communications established by the microcontroller (7') comprise Wi-Fi or Bluetooth Low Energy.

17. A system for monitoring the contraction movement of the pelvic floor muscles comprising the device according to claim 15 and an external computation device running a software program, the external device configured to establish a wireless communication with the microcontroller (7') of the main component (A').

18. A method of device the system according to claim 15 comprising the steps of:

performing at least one pelvic floor muscle exercise with the device;

monitoring the performance of the movement of the contraction of the pelvic floor muscle with the software program running in the external computation device.

19. The system as claimed in claim 15, wherein the device is configured for treatment and/or prevention of pathological situations related to the alteration of muscle function in the pelvic floor region.

* * * * *